US005404153A

United States Patent [19]

Kim

[11] Patent Number: 5,404,153

[45] Date of Patent: Apr. 4, 1995

[54] SUPER VGA MONITOR INTERFACE CIRCUIT

[75] Inventor: Manbok Kim, Kyungsangbuk, Rep. of Korea

[73] Assignee: Samsung Electron Devices Co., Ltd., Kyunggi, Rep. of Korea

[21] Appl. No.: 967,194

[22] Filed: Oct. 27, 1992

[30] Foreign Application Priority Data

Nov. 22, 1991 [KR] Rep. of Korea ..... 91-20953

[51] Int. Cl.[6] ..... G09G 3/00

[52] U.S. Cl. ..... 345/213; 345/132

[58] Field of Search ..... 340/814, 811, 703, 731, 340/717, 721; 345/213, 212, 211, 127, 132, 150, 154, 155; 358/148, 150, 153

[56] References Cited

U.S. PATENT DOCUMENTS

| | | | |
|---|---|---|---|
| 4,727,362 | 2/1988 | Rackley et al. | 345/213 |
| 4,792,857 | 12/1988 | Akiyama | 340/814 |
| 4,916,442 | 4/1990 | Kim | 345/213 |
| 4,935,731 | 6/1990 | Takebe et al. | 345/132 |
| 4,990,902 | 2/1991 | Zenda | 345/132 |
| 4,991,023 | 2/1991 | Nicols | 345/213 |
| 5,153,886 | 10/1992 | Tuttle | 371/67.1 |
| 5,159,327 | 10/1992 | Yi | 340/814 |

*Primary Examiner*—Ulysses Weldon

*Assistant Examiner*—Xiao M. Wu

*Attorney, Agent, or Firm*—Christie, Parker & Hale

[57] ABSTRACT

The conventional super VGA (video graphic array) monitor interface circuit controls the output mode of the monitor according to the width and polarity of vertical and horizontal synchronizing input signals, so it has disadvantage that it is difficult to control the output mode of the monitor when the width and polarity of the vertical and horizontal synchronizing input signals are different according to the kind of video cards. The present invention is such that the vertical and horizontal synchronizing signals are employed as an input signal. If the input signal is negative polarity, it is converted to positive polarity for output and, if the input signal is positive polarity, it is output with positive polarity. The signal separating part divides the input signal connected to the above polarity converting part into an 800×600 mode, a 1024×768 mode or any other mode. An output part which is connected to a polarity converting part and signal separating part outputs a control signal needed in a monitor by dividing the input signal into each mode. Thus, the present invention relates to the super VGA monitor interface circuit which solves conventional problems in the art by controlling the output mode of the monitor only by an input signal frequency regardless of the width and polarity of the vertical and horizontal synchronizing input signals.

4 Claims, 2 Drawing Sheets

SUPER VGA MONITOR INTERFACE CIRCUIT

BACKGROUND OF THE INVENTION (1) Field of the Invention

The present invention relates to a super VGA (video graphic array) monitor interface circuit and, more particularly, to a super VGA monitor interface circuit in which an output mode of a monitor is controlled by an input signal frequency regardless of the width and polarity of vertical and horizontal synchronizing input signals.

(2) Related Prior Art

A conventional super VGA (video graphic array) interface circuit controls an output mode of a monitor according to the width and polarity of vertical and horizontal synchronizing input signals. Because the resolution and screen display technique of the monitor becomes different in accordance with the output mode of the monitor, it is considerably important to definitely divide the output modes. The exact dividing and controlling of the output mode of the monitor makes the definite display of the picture information on a screen possible.

However, because the conventional super VGA monitor interface circuit controls the output mode of the monitor according to the width and polarity of the vertical and horizontal synchronizing input signals, it is difficult to control the output mode of the monitor when the width and polarity of the vertical and horizontal synchronizing input signals are different from each other to the kind of video cards.

SUMMARY OF THE INVENTION

Thus, to overcome the above-described conventional art, an object of the present invention is to provide a super VGA monitor interface circuit which controls the output mode of a monitor only by a frequency of an input signal regardless of the width and polarity of vertical and horizontal synchronizing input signals.

The structure of the present invention is formed by a polarity converting part in which the vertical and horizontal synchronizing signals are employed as an input signal, and, if the input signal is negative polarity, it is converted to positive polarity to be output, whereas, if the input signal is positive polarity, it is output as positive polarity; a signal separating part which divides the input signals into 800×600 mode, 1024×768 mode and the other mode with being connected to the above polarity converting part; and an output part which is connected to the polarity converting part and signal separating part and divides the input signals into each mode to output a control signal needed in a monitor.

BRIEF DESCRIPTION OF THE DRAWINGS

Further advantages and other objects of the present invention will be apparent from the detailed description of the invention in connection with the accompanying drawings, in which.

DETAILED DESCRIPTION OF THE PREFERRED EMBODIMENTS

Figure 1:
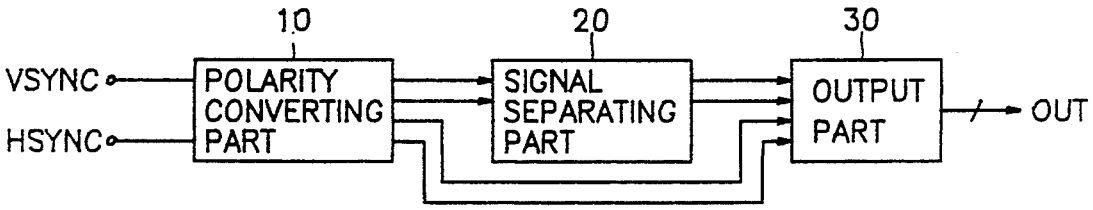
FIG. 1 is a whole block diagram of a super VGA (video graphic array) interface circuit of an embodiment of the present invention.

The preferred embodiment of the present invention of the above structure will be, in detail, disclosed with reference to the drawings as follows. FIG. 1 shows, in a block diagram, a super VGA (video graphic array) interface circuit of an embodiment of the present invention. As revealed in the figure, the super VGA interface circuit structure has

- a polarity converting part 10 employing vertical and horizontal synchronizing signals VSYNC, HSYNC as an input signal;
- a signal separating part 20 where input terminals are connected to an output terminal of the polarity converting part 10; and
- an output part 30 where input terminals are connected to the output terminals of the polarity converting part 10 and signal separating part 20.

Figure 2:
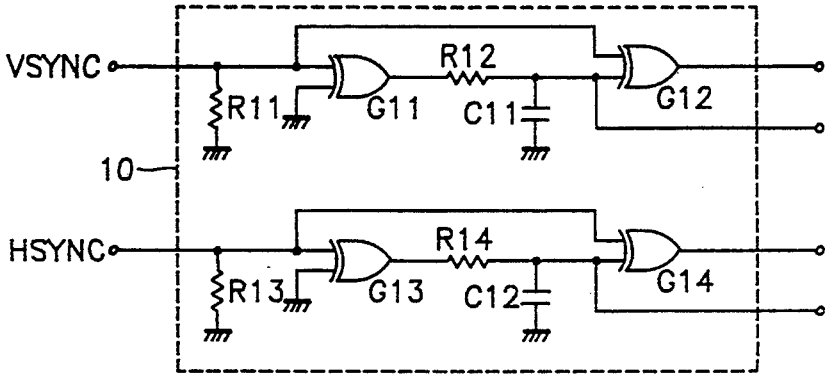
FIG. 2 is a detailed circuit diagram of a polarity converting part of an embodiment of the present invention.

FIG. 2 shows, in a circuit diagram, the polarity converting part of an embodiment of the present invention. As revealed in the figure, the polarity converting part 10 has

- a resistor R11 connected between a vertical synchronizing signal line VSYNC and a ground;
- a first exclusive OR gate G11 where one input terminal is connected to the vertical synchronizing signal line VSYNC, and another input terminal is grounded;
- the resistor R12 where one terminal is connected to an output terminal of the first exclusive OR gate G11;
- a capacitor C11 connected between another terminal of the resistor R12 and the ground;
- a second exclusive OR gate G12 where one input terminal is connected to the connecting point of the resistor R12 and the capacitor C11, and another input terminal is connected to the vertical synchronizing signal line VSYNC;
- the resistor R13 connected between a horizontal synchronizing signal line HSYNC and the ground;
- a third exclusive OR gate G13 where one input terminal is connected to the horizontal synchronizing signal line HSYNC, and another input terminal is grounded;
- the resistor R14 where one terminal is connected to an output terminal of the third exclusive OR gate G13;
- the capacitor C12 connected between another terminal of the resistor R14 and the ground; and
- a fourth exclusive OR gate G14 where one input terminal is connected to one terminal of the resistor R14, and another input terminal is connected to the horizontal synchronizing signal line HSYNC.

Figure 3:
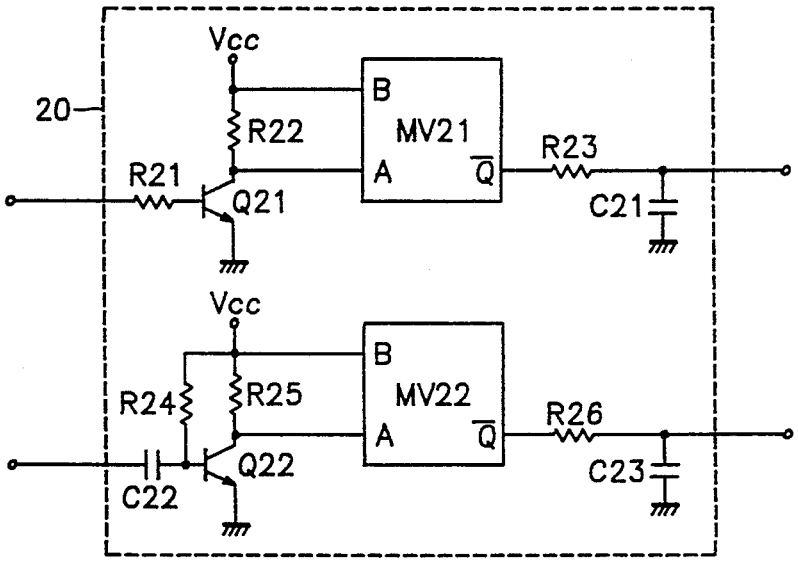
FIG. 3 is a detailed circuit diagram of a signal separating part of an embodiment of the present invention.

FIG. 3 shows, in a circuit diagram, the signal separating part of an embodiment of the present invention. As revealed in the figure, the signal separating part 20 has

- the resistor R21 where one terminal is connected to the output terminal of the second exclusive OR gate G12 of the polarity converting part 10;
- a first transistor Q21 where a base terminal is connected to another terminal of the resistor R21, and an emitter terminal is grounded;
- the resistor R22 connected between a supply voltage Vcc and a collector terminal of the first transistor Q21;

a first monostable multivibrator MV21 where an A input terminal is connected to the collector terminal of the first transistor, and a B input terminal is connected to the supply voltage Vcc;

the resistor R23 where one terminal is connected to a reverse output terminal $\overline{Q}$ of the monostable multivibrator MV21;

the capacitor C21 connected between another terminal of the resistor R23 and the ground;

the capacitor C22 where one terminal is connected to the output terminal of the fourth exclusive OR gate G14 of the polarity converting part 10;

a second transistor Q22 in which the base terminal is connected to another terminal of the capacitor C22, and the emitter terminal is grounded;

the resistor R25 connected between the supply voltage Vcc and the collector terminal of the second transistor Q22;

the resistor R24 connected between the supply voltage Vcc and the base terminal of the second transistor Q22;

a second monostable multivibrator MV22 where the A input terminal is connected to the collector terminal of the second transistor, and the B input terminal connected to the supply voltage Vcc;

the resistor R26 where one terminal is connected to a reverse output terminal $\overline{Q}$ of the second monostable multivibrator MV22; and the capacitor C23 connected between another terminal of the resistor R26 and the ground.

In the embodiment of the invention, an MC14538B chip is used as a monostable multivibrator MV21, MV22. However, the technical range of the invention is not limited within that.

Figure 4:
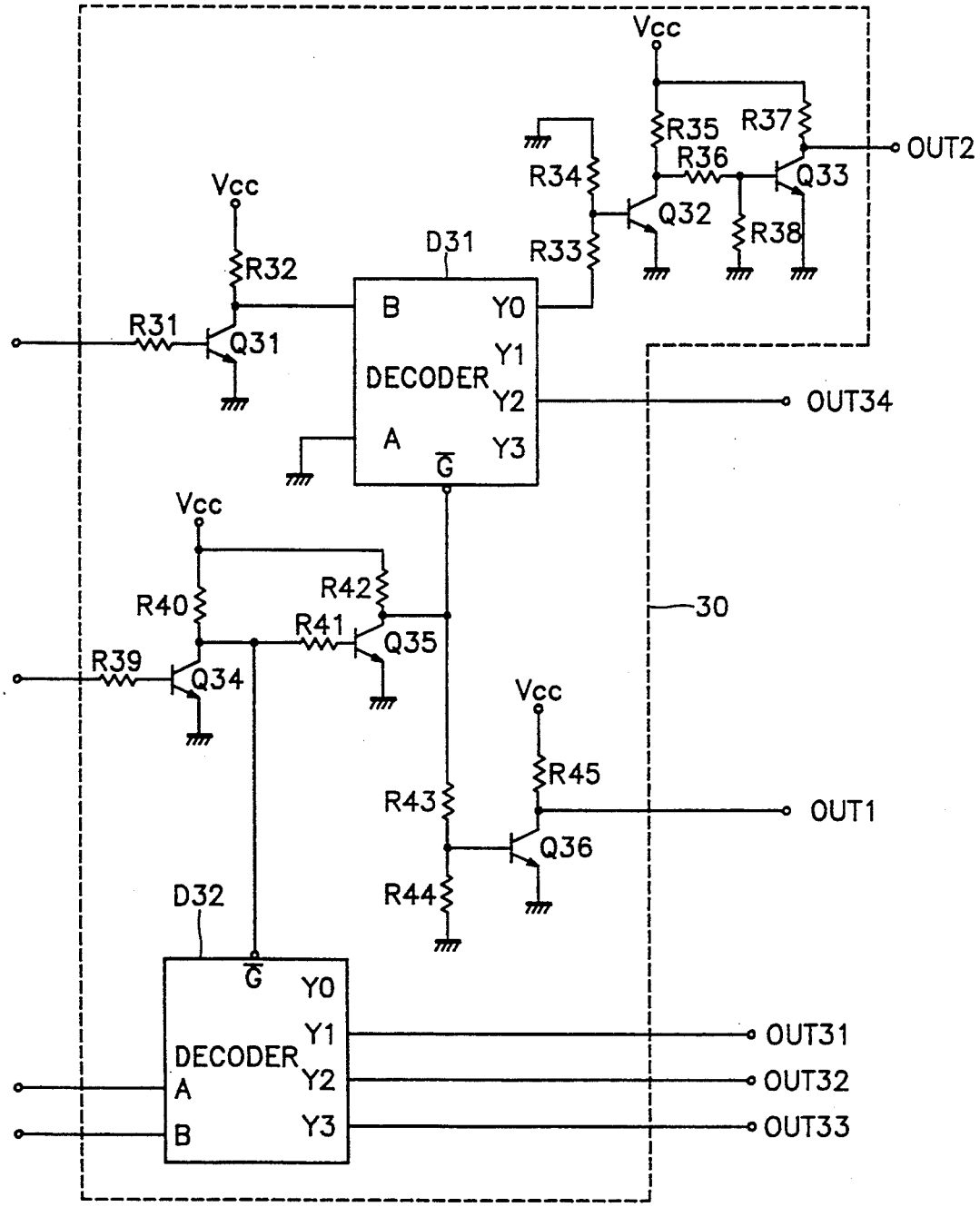
FIG. 4 is a detailed circuit diagram of an output part of an embodiment of the present invention.

FIG. 4 shows, in a circuit diagram, an output part of an embodiment of the present invention. As revealed in the figure, the output part has the resistor R31 where one terminal is connected to the connecting point of the resistor R23, and the capacitor C21 of the signal separating part;

the transistor Q31 where the base terminal is connected to another terminal of the resistor R31, and the emitter terminal is grounded;

the resistor R32 connected between the supply voltage Vcc and the collector terminal of the transistor Q31;

the resistor R39 where one terminal is connected to the connecting point of the resistor R26*a* and the capacitor C23, of the signal separating part 20;

the transistor Q34 where the base terminal is connected to another terminal of the resistor R39, and the emitter terminal is grounded;

the resistor R40 connected between the supply voltage Vcc and the collector terminal of the transistor Q35;

the resistor R41 where one terminal is connected to the collector terminal of the transistor Q34;

the transistor Q35 where a base terminal is connected to another terminal of the resistor, and an emitter terminal is grounded;

the resistor R42 connected between the supply voltage Vcc and the collector terminal of the transistor Q35;

a first decoder D31 where the B input terminal is connected to the collector terminal of the transistor Q31, the A input terminal is grounded, and an enable terminal $\overline{G}$ is connected to the collector terminal of the transistor Q35;

the resistor R43 where one terminal is connected to the collector terminal of the transistor Q35;

the resistor R44 connected between another terminal of the resistor R43 and the ground;

the transistor Q36 where the base terminal is connected to the connecting point of the resistors R43, R44, and the emitter terminal is grounded;

the resistor R45 connected between the collector terminal of the transistor Q36 and the supply voltage Vcc;

a second decoder D32 where the A input terminal is connected to the connecting point of the resistor R12, and capacitor C11 of the polarity converting part 10, the B input terminal is connected to the connecting point of the resistor R14 and capacitor C12 of the polarity converting part 10, and the enable terminal $\overline{G}$ is connected to the collector terminal of the transistor Q34;

the resistor R33 where one terminal is connected to an output terminal Y0 of the first decoder D31;

the resistor R34 connected between another terminal of the resistor R33 and the ground;

the transistor Q32 where the base terminal is connected to the connecting point of the resistors R33, R34, and the emitter terminal is grounded;

the resistor R35 connected between the collector terminal of the transistor Q32 and the supply voltage Vcc;

the resistor R36 where one terminal is connected to the collector terminal of the transistor Q32;

the resistor R38 connected between another terminal of the resistor R36 and the ground;

the transistor Q33 where the base terminal is connected to the connecting point of the resistors R36, R38, and the emitter terminal is grounded; and the resistor R37 connected between the collector terminal of the transistor Q33 and the supply voltage Vcc.

In this embodiment of the present invention, a 74139 chip is used as the decoders D31, D32. However, the usable range of the invention is not limited to the above description.

According to the embodiment of the present invention of the above structure, the operation of the super VGA (video graphic array) monitor interface circuit is as follows.

After applying the supply voltage Vcc, the vertical and horizontal synchronizing signals VSYNC, HSYNC of modes such as in Table 1 are input into the polarity converting part 10.

TABLE 1

| | VSYNC | | HSYNC | |
|---|---|---|---|---|
| MODE | frequency | polarity | frequency | polarity |
| 640 × 480 | 60 Hz | − | 31.5 KHz | − |
| 640 × 400 | 70 Hz | + | 31.5 KHz | − |
| 640 × 350 | 70 Hz | − | 31.5 KHz | + |
| 800 × 600 | 56 Hz | − | 35.5 KHz | − |
| 1024 × 768 | 87 Hz | + | 35.5 KHz | + |

When a duty cycle of the input signal is small, it is called a positive polarity. When the duty cycle is large, it is called a negative polarity. According to the characteristics of video cards, there may be a difference in the polarity input signal of each mode. The range is not limited by the polarity of the input signal of Table 1 as shown above.

The input signals VSYNC, HSYNC pass through the first and third exclusive OR gate G11, G13 and the capacitors C11, C12 are, respectively, charged. Since the duty cycle is large when the polarity of the input signal VSYNC, HSYNC is positive, the capacitors C11, C12 are, respectively, charged with a high potential. Whereas, those which are negative when the duty cycle is small, the capacitors C11, C12 are, respectively, charged with a low potential. When the polarity of the input signals VSYNC, HSYNC is negative, the input signals are reversed to output signals. When the input signals are positive, the input signals are then output.

If the output signal of the polarity converting part 10 is input into the signal separating part 20, the signal separating part 20 is operated. If the signal a high state is input into the base terminal of the transistors Q21, Q22, the transistors Q21, Q22 turn on. If the signal of a low state is input into the base terminal of the transistors Q21, Q22, the transistors turn off, so that the phase of the input signal is reversed to output, and the output signals of the transistors Q21, Q22 are input into the A terminals of the first and second monostable multivibrators MV21, MV22.

The first monostable multivibrator MV21 has the operating characteristics that when it is triggered at the positive-going edge of the input signal, the reverse output terminal $\overline{Q}$ has a low state during a period of time which is comparatively somewhat less than 1/87(HZ). Thus, when the input signal is in a 1024×768 mode, the capacitor C21 is charged by the low potential to be output. When it is in the other mode, the capacitor C21 is charged by the high potential to be output. The second monostable multivibrator MV22 has the operating characteristics that when it is triggered at the top edge of the A input signal, the reverse output terminal $\overline{Q}$ has a low state during a period of time which is somewhat less than 1/35.5(KHZ). Accordingly, when the input signal is in an 800×600 mode or 1024×768 mode, the capacitor is charged by the low potential to be output. When it is in the other mode, the capacitor C22 is charged by the high potential to be output.

If the output signal of the signal separating part 20 is input into the output part 30, the output part 30 is operated. When the high state signal is input into the transistor Q34, it turns on. Thus, the second decoder D32 is enabled, and the transistor Q35 turns off. Because the transistor Q35 turns off, the first decoder D31 is disabled, and the transistor Q36 turns on. However, if the low state signal is input into the transistor Q34, it turns off. The second decoder D32 is disabled, and the transistor Q35 turns on. Thus, the transistor Q35 turns on, so that the first decoder D31 is enabled, and the transistor Q36 turns off.

Thus, when the input signal is in a 800×600 mode or 1024×768 mode, the low state signal is output to the output terminal OUT1. When the input signal is in the other mode, the high state signal is output.

When the first decoder D31 is disabled, the output terminals Y0, Y2 output the high state signal. When the first decoder D31 is enabled, and when the input signal of the transistor Q31 is in a low state, the transistor Q31 turns off. When the B input terminal of the decoder D31 is supplied with a high state signal, the output terminals Y0, Y2 of the first decoder D31 each output the low and high state signals. Also, when the first decoder D31 is enabled, and when the input signal of the transistor Q31 is in a high state, the transistor Q31 turns on. When the B terminal of the decoder D31 is supplied with the low state signal, then the output terminals Y0, Y2 of the first decoder D31 each output the high and low state signals.

When the output signal of output terminal Y0 of the first decoder D31 is in a high state, transistor Q32 turns on, and transistor Q33 turns off. Thus, the collector terminal of transistor Q33 outputs the high state signal. However, when the output signal of output terminal Y0 of the first decoder D31 is in a low state, transistor Q32 turns off, and transistor Q33 turns on. Accordingly, the collector terminal of transistor Q33 outputs the low state signal.

When the input signal is in the 800×600 mode, the low state signal is output to the second output terminal OUT2. In case of the other mode, the high state signal is output.

When the second decoder D32 is disabled, the output terminals Y1, Y2, Y3 output the high state signal. When the second decoder D32 is enabled, the second decoder D32 of the output terminals Y1, Y2, Y3 output the decoding signal of the A and B input signals.

Table 2 shows the result of changing the output signals OUT1, OUT2, OUT31–OUT34 of output part 30 according to the mode of the vertical and horizontal synchronizing input signals VSYNC, HSYNC.

TABLE 2

| mode | OUT1 | OUT2 | OUT31 | OUT32 | OUT33 | OUT34 |
|---|---|---|---|---|---|---|
| 640 × 480 | L | H | H | H | L | H |
| 640 × 400 | L | H | H | L | H | H |
| 640 × 350 | L | H | L | H | H | H |
| 800 × 600 | H | L | H | H | H | H |
| 1024 × 768 | H | H | H | H | H | L |

Note)
L is represented as the low state.
H is represented as the high state.

The above output signal OUT1 is used as the control signal of B+, H-Hold, H-SHIFT, and the like, by dividing the horizontal synchronizing signal frequencies of 31.5 kHz and 35.5 kHz. The output signal OUT2 is used as the control signal of H-SHIFT, V-HOLD, and the like, by dividing the basic mode of 800×600 mode. The output signals OUT31–OUT 34 are used as the control signal of V-SIZE and the line by dividing each mode.

As described above, the embodiment of the present invention can provide the super VGA monitor interface circuit which may control the output mode only by the input signal frequency regardless of the width and polarity of the vertical and horizontal synchronizing input signals. Such effect of the present invention can be applied to the information output field using the monitor of the computer.

What is claimed is:

1. A super VGA (video graphic array) monitor interface circuit comprising:

a polarity converting part receiving vertical and horizontal synchronizing signals as an input signal and converting the input signal to positive polarity to be output in response to the input signal being negative polarity when of a relatively large duty cycle, and the input signal is output with positive polarity in response to the input signal being positive polarity when of a small duty cycle relative to the large duty cycle, the output of the polarity converting part comprising first output signals;

a signal separating part for receiving the first output signals from the polarity converting part and generating second output signals indicative of a selected array mode, whereby the selected array mode may be one of an 800×600 mode, a 1024×768 mode, and any other mode, the signal operating part including a first transistor for being turned on when one of said first outputs is high and off when it is low, and a second transistor for being turned on when the other of said first outputs is high and off when it is low, a first monostable multivibrator having A and B input terminals and a $\overline{Q}$ reverse output terminal, and a second monostable multivibrator having A and B input terminal and a $\overline{Q}$ reverse output terminal; wherein when the first transistor changes from off to on, the first monostable multivibrator is triggered, the $\overline{Q}$ output terminal having a low state for less than 1/87 Hz, and the second monostable multivibrator having A and B input terminals and a $\overline{Q}$ output terminal, such that the second monostable multivibrator is triggered at a top edge of the A input signal and the $\overline{Q}$ output terminal has a low state during less than 1/35.5 KHz; and an output part for receiving the first and second output signals and for outputting a control signal needed in a monitor by dividing the first output signals into each mode in response to the second output signals from the signal separating part.

2. The super VGA monitor interface circuit as claimed in claim 1 wherein the polarity converting part comprises:

a first resistor connected between a vertical synchronizing signal line and a ground;

a first exclusive OR gate having one input terminal which is connected to the vertical synchronizing signal line and another input terminal which is grounded;

a second resistor having one terminal which is connected to the output terminal of the first exclusive OR gate;

a first capacitor connected between another terminal of the second resistor and ground;

a second exclusive OR gate having one input terminal which is connected to the connecting point of the second resistor and the first capacitor and another input terminal which is connected to the vertical synchronizing signal line;

a third resistor connected between a horizontal synchronizing signal line and ground;

a third exclusive OR gate having one input terminal which is connected to the horizontal synchronizing signal line and another input terminal which is grounded;

a fourth resistor having one terminal which is connected to the output terminal of the third exclusive OR gate;

a second capacitor connected between another terminal of the fourth resistor and ground; and a fourth exclusive OR gate having one input terminal which is connected to a connecting point of the fourth resistor and the capacitor and another input terminal which is connected to the horizontal synchronizing signal line.

3. The super VGA monitor interface as claimed in claim 2 wherein the signal separating part further comprises:

a first resistor in which one terminal is connected to the output terminal of the second exclusive OR gate of the polarity converting part;

the first transistor in which a base terminal is connected to another terminal of the first resistor of the signal separating part and an emitter terminal is grounded;

a second resistor connected between a supply voltage and a collector terminal of the first transistor;

the first monostable multivibrator in which the A input terminal is connected to the collector terminal of the first transistor and the B input terminal is connected to the supply voltage;

a third resistor of which one terminal is connected to a reverse output terminal of the first monostable multivibrator;

a first capacitor connected between another terminal of the third resistor of the signal separating part and ground;

a second capacitor in which one terminal is connected to the output terminal of the fourth exclusive OR gate of the polarity converting part;

the second transistor in which the base terminal is connected to another terminal of the second capacitor of the signal separating part and an emitter terminal is grounded;

a fourth resistor connected between the supply voltage and the collector terminal of the second transistor;

a fifth resistor connected between the supply voltage and the base terminal of the second transistor;

the second monostable multivibrator in which the A input terminal is connected to the collector terminal of the second input terminal and the B input terminal is connected to the supply voltage;

a sixth resistor in which one terminal is connected to a reverse output terminal of the second monostable multivibrator; and a third capacitor connected between another terminal of the sixth resistor and ground.

4. The super VGA monitor interface as claimed in claim 3 wherein the output part comprises:

a first resistor in which one terminal is connected to the connecting point of the third resistor and the first capacitor of the signal separating part;

a first transistor in which a base terminal is connected to another terminal of the first resistor of the output part and an emitter terminal is grounded;

a second resistor connected between a supply voltage and a collector terminal of the first transistor of the output part;

a third resistor in which one terminal is connected to the connecting point of the sixth resistor and the third capacitor of the signal separating part;

a second transistor in which the base terminal is connected to another terminal of the third resistor of the output part and the emitter terminal is grounded;

a fourth resistor connected between the supply voltage and the collector terminal of the second transistor of the output part;

a fifth resistor in which one terminal is connected to the collector terminal of the second transistor of the output part;

a third transistor in which a base terminal is connected to another terminal of the fifth resistor of the output part and an emitter terminal is grounded;

a sixth resistor connected between the supply voltage and the collector terminal of the third transistor of the output part;

a first decoder in which the B input terminal is connected to the collector terminal of the first transistor of the output part, the A input terminal is grounded and an enable terminal is connected to the collector terminal of the third transistor of the output part;

a seventh resistor in which one terminal is connected to the collector terminal of the third transistor of the output part;

an eighth resistor connected between another terminal of the seventh resistor and ground;

a fourth transistor in which the base terminal is connected to the connecting point of the seventh and eighth resistors and the emitter terminal is grounded;

a ninth resistor connected between the collector terminal of the fourth transistor of the output part and the supply voltage;

a second decoder in which the A input terminal is connected to the connecting point of the second resistor and the first capacitor of the polarity converting part, the B input terminal is connected to the connecting point of the fourth resistor and the second capacitor of the polarity converting part, and the enable terminal is connected to the collector terminal of the second transistor of the output part;

a tenth resistor in which one terminal is connected to an output terminal of the first decoder;

an eleventh resistor connected between another terminal of the tenth resistor and ground;

a fifth transistor in which the base terminal is connected to the connecting point of the tenth and eleventh resistors and the emitter terminal is grounded;

a thirteenth resistor connected between the collector terminal of the fifth transistor and the supply voltage;

a fourteenth resistor in which one terminal is connected to the collector terminal of the fifth transistor;

a fifteenth resistor connected between another terminal of the fourteenth resistor and ground;

a sixth transistor in which the base terminal is connected to the connecting point of the fourteenth and fifteenth resistors and the emitter terminal is grounded; and a sixteenth resistor connected between the collector terminal of the sixth transistor and the supply voltage.

* * * * *

UNITED STATES PATENT AND TRADEMARK OFFICE

CERTIFICATE OF CORRECTION

PATENT NO. : 5,404,153

DATED : April 4, 1995

INVENTOR(S) : Manbok Kim

It is certified that error appears in the above-indentified patent and that said Letters Patent is hereby corrected as shown below:

ABSTRACT, line 5, before "disadvantage" insert -- the --.

Column 1, line 33, after "other" insert -- according --.
Column 1, line 50, after "other mode" delete "with".

Column 3, line 48, change "R26a" to -- R26 --.

Column 4, lines 56-60, change "KHz" to -- kHz -- (all occurrences).
Column 4, line 59, change the dash to a minus sign.

Column 5, line 15, after "signal" insert -- of --.
Column 5, line 25, change "characteristics" to -- characteristic --.
Column 5, line 28, change "HZ" to -- Hz --.
Column 5, line 34, change "characteristics" to -- characteristic --.
Column 5, line 37, change "KHZ" to -- kHz --.

Column 6, line 33, change "Note)" to -- (Note) --.

UNITED STATES PATENT AND TRADEMARK OFFICE

CERTIFICATE OF CORRECTION

PATENT NO. : 5,404,153

DATED : April 4, 1995

INVENTOR(S) : Manbok Kim

It is certified that error appears in the above-indentified patent and that said Letters Patent is hereby corrected as shown below:

Column 7, line 20, change "KHz" to -- kHz --.

Signed and Sealed this

Nineteenth Day of December, 1995

*Attest:*

*Attesting Officer*

BRUCE LEHMAN

*Commissioner of Patents and Trademarks*